US005346551A

United States Patent [19]

Pannenbecker et al.

[11] Patent Number: 5,346,551

[45] Date of Patent: Sep. 13, 1994

[54] DEVICE FOR BLOWING OFF COATING MATERIAL IN THE COATING OF METAL BANDS

[75] Inventors: Heinrich Pannenbecker, Duisburg; Ronald Jabs, Moers; Heinrich Schmitz, Dinslaken; Wulf Dechene, Düsseldorf-Angermund; Manfred Splitt, Finnentrop; Hans-Joachim Heiler, Moers, all of Fed. Rep. of Germany

[73] Assignee: Thyssen Stahl AG, Duisburg

[21] Appl. No.: 976,986

[22] PCT Filed: Jul. 9, 1991

[86] PCT No.: PCT/EP91/01273

§ 371 Date: Mar. 18, 1993

§ 102(e) Date: Mar. 18, 1993

[87] PCT Pub. No.: WO92/02656

PCT Pub. Date: Feb. 20, 1992

[30] Foreign Application Priority Data

Jul. 31, 1990 [DE] Fed. Rep. of Germany ..... 4024229

[51] Int. Cl.[5] ..... B05C 3/12

[52] U.S. Cl. ..... 118/63; 118/423; 427/348; 427/349; 15/309.1

[58] Field of Search ..... 118/63, 423; 15/309.1; 239/455, 590; 427/348, 349

[56] References Cited

U.S. PATENT DOCUMENTS

| | | | |
|---|---|---|---|
| 3,941,086 | 3/1976 | Roncan . | |
| 4,513,915 | 4/1985 | Kohler | 118/63 |

FOREIGN PATENT DOCUMENTS

| | | | |
|---|---|---|---|
| 0249234 | 12/1987 | European Pat. Off. . | |
| 2093359 | 1/1972 | France . | |
| 55-107767 | 8/1980 | Japan . | |
| 62-133056 | 6/1987 | Japan . | |
| 1376521 | 12/1974 | United Kingdom | 118/63 |

*Primary Examiner*—W. Gary Jones
*Assistant Examiner*—John Hoffman
*Attorney, Agent, or Firm*—Meltzer, Lippe, Goldstein Wolf, Schlissel & Sazer

[57] ABSTRACT

The invention relates to a device for blowing off excessive coating material, especially fluid zinc or aluminium, in the coating of metal bands. The device comprises a blowing off jet impinged on compressed air, of which the jet bodies 3,4 are fixed at a base body 1. The jet lips 3,4 adjustable against each other form a jet slit 10 extending in transverse direction of the metal band. For optimizing an adaption of the slit thickness respectively the pressure of the blowing off medium along the band width it is provided to build the blowing off jet as a jet row, providing in transverse direction of the band at least two partial jets 2 to impinge seperately on a blowing off medium, especially compressed air, sealed against each other, of which the respective partial slits are adjacent forming a continuous jet slit (10).

6 Claims, 3 Drawing Sheets

DEVICE FOR BLOWING OFF COATING MATERIAL IN THE COATING OF METAL BANDS

The invention relates to a device for blowing off excessive coating material, particularly fluid zinc or aluminium, in the coating of metal bands by the means of a blowing off jet to impinge by a blowing off medium, of which the jet body is fixed at a base body and of which the jet kips adjustable against each other form a jet slit 10 extending in transverse direction of the metal band.

Such a blowing off device is known from the DE-OS 3619805. By means of such a known blowing off jet the excessive coating agent, especially zinc or aluminium, in the coating of metal bands is blown off along the whole width of the metal band. Hereby results an equal coating of the coating agent over the the whole band width. For such a known blowing off device the blowing off jet has a jet slit along the band width, which can be adapted to the required blowing off conditions by displacement of the jet lips against each other. Besides, the pressure of the blowing off medium is adjustable in the known device to create also thereby most optimal blowing off conditions.

In practical use of the known device it was shown that because of the band vault or bruises of the coating material an equal blowing off process was not sufficiently provided, because in the known device there is always the same pressure over the whole width of the jet slit.

Therefore the invention is directed to improve a device of the above mentioned type so that a blowing off process becomes possible taking into account the bruises of the band to coat.

This object is achieved according to the invention by having a blowing off jet formed as a jet row, providing in transverse direction of the band at least two partial jets to impinge separately on a blowing off medium, especially compressed air, sealed against each other, of which the respective partial slits are adjacent forming a continuous jet slit.

The invention has the advantage that the blowing off jet takes the form of a jet row with single partial jets, whereby each partial jet can be impinged on different pressure to adjust to an optimum the pressure profile along the width of the band to coat. Thereby the variety of working possibilities can be increased sensibly. It is also possible to blow two or more bands simultaneously with one jet row, obtaining different coating layers for each partial band. Besides the solution according to the invention has the advantage to achieve an economic handling with the blowing off medium at disposition, because at such places where less blowing off medium is required a reduction can be made and only such partial jets must be impinged adequately higher where it is necessary. By a concerted cut-off of the individual partial jets a variable adaption to the respective band width can be made.

A preferred embodiment of the invention has to be seen in that each partial jet is made of a first jet half and a second jet half, the first jet half having a channel for leading the blowing off medium to the jet slit and the second jet half being solid so that in an alternating arrangement of the partial jets by exchanging the first and the second jet half in transverse direction of the band the respective second jet half is sealing adjacent to the adjoining first jet halfs.

For this embodiment results an especially simple geometric structure, because for the whole jet row the same structural basic units can be applied which only have to be joined together alternately. The particular advantage must be seen in the solid form of the second jet half serving so simultaneously as seal against the adjacent first jet halfs.

Therefore supplementary sealing elements are not necessary.

Providing sealing plates at both edge regions of the jet row also the partial jets placed in the edge region can be impinged on compressed air separately from the others.

In accordance with another aspect of the invention there is provided another pair of jet lips with another adjustable continuous jet slit along the jet row. Thereby it is secured that the metal band to blow is subjected to a slot jet with exactly linear slit, the pressure conditions however being variably adjustable along the band width. This offers another improvement of the blowing off conditions.

A transposition of the pressure conditions formed by the first respectively second jet half without any important pressure loss into the other jet slit formed by the other pair of jet lips occurs, if a seal is provided which seals the other pair of jet lips against the partial jets.

The invention will be more disclosed in the following, with reference to an example of embodiment.

Figure 2:
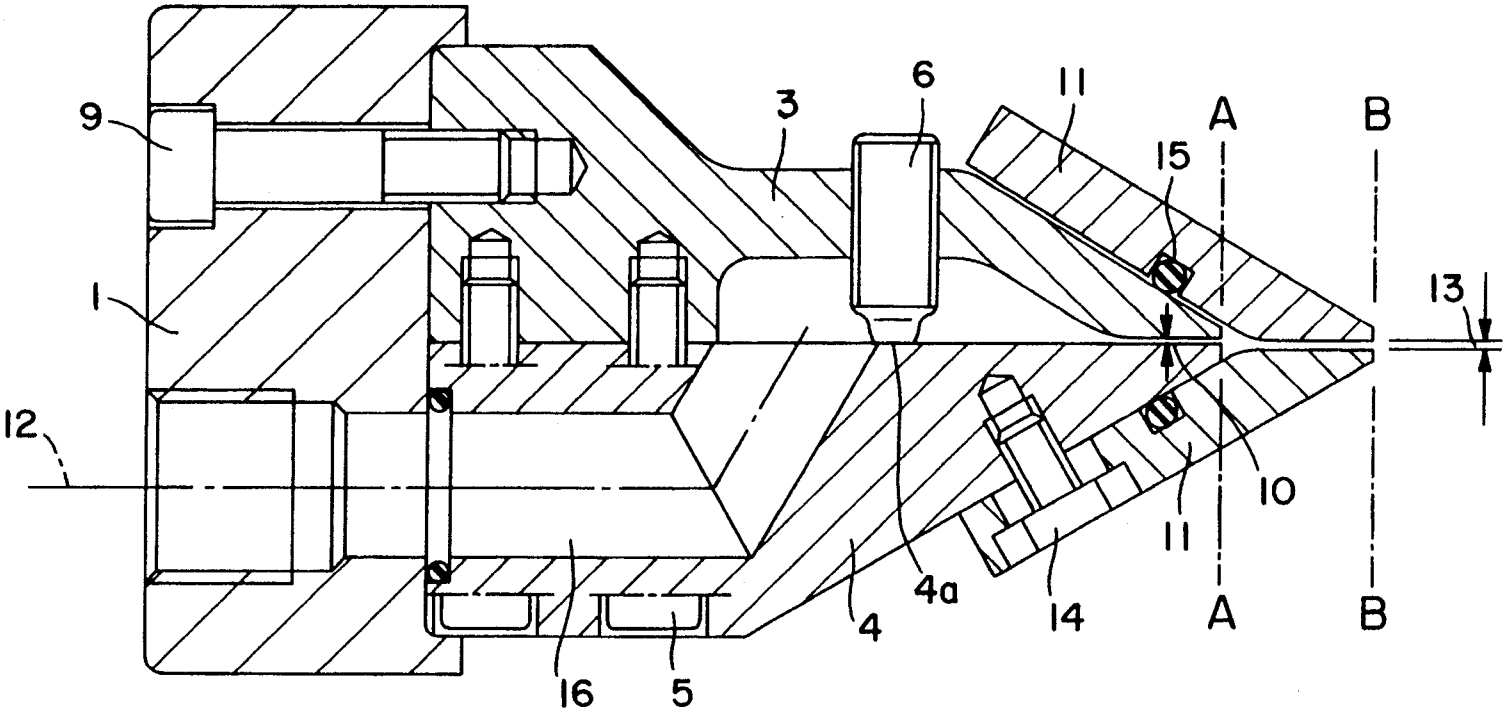
FIG. 2 is a section along line I—I in FIG. 1.

The blowing off device according to the invention substantially comprises a jet body represented in the right part of FIG. 2 and fixed by a fastening screw 9 at a base body 1. Under the fastening screw 9 in the base body 1 a compressed-air supply 12 is provided which is connected to a compressed-air channel 16 and can be impinged externally on compressed air.

The compressed-air channel 16 extends from the compressed-air supply 12 to a jet slit opening 10.

The compressed-air channel 16 is hereby partial jets 2 consisting of by a first jet half 3 and a second jet half 4, which are connected to each other by straining screws 5.

In the region of the jet slit 10 the compressed-air channel 16 extends exclusively inside the first jet half, the second jet half 4 being formed solid in this region.

The second jet half 4 has in its solid region a shoulder **4*a*, on which stays a binding screw 6 which is inserted in a screw thread in the first jet half 3. By rotation of the binding screw 6 the width of the jet slit opening 10** is adjustable.

The regions of the first jet half 3 and the second jet half 4 placed in the region of the jet slit opening 10 cooperate in the way of a pair of jet lips.

In the region outside the jet slit opening 10 another pair of jet lips 11 is placed which is sealed by a seal 15 against the first respectively second jet half 3 respectively 4 and fixed in the solid region of the second jet half 4 by means of a binding screw 14. The other pair of jet lips 11 forms at its point another jet slit 13 which also is adjustable by adjustment of the binding screw 14.

Figure 1:
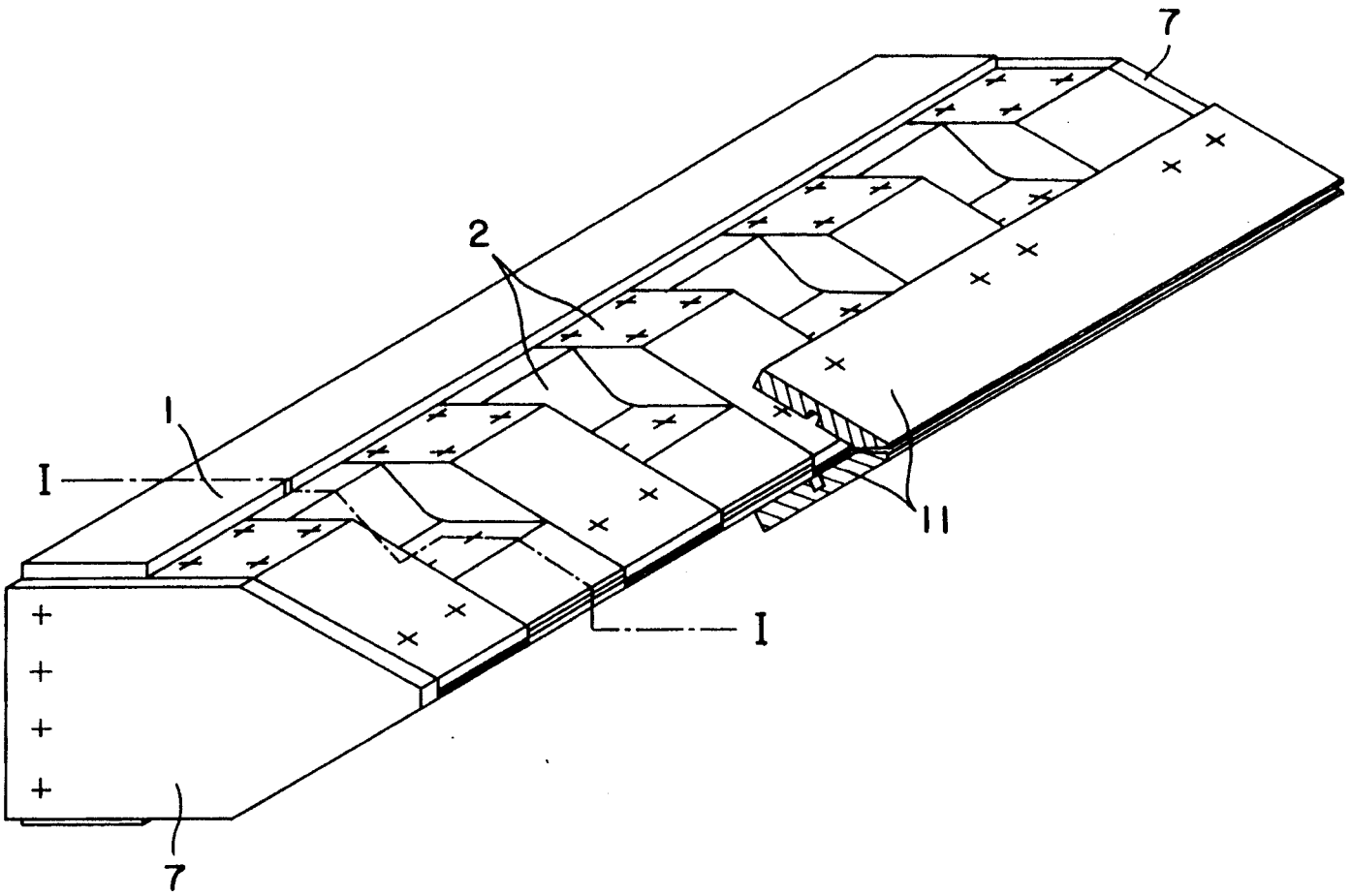
FIG. 1 is a perspective view of a blowing off device according to the invention.

As it can be seen in FIG. 1, the arrangement of the partial jets represented in FIG. 2 is repeated along the width of the metal band to coat which extends in direction of the jet slit 10 respectively of the other jet slit 13. However the partial jets represented in FIG. 2 are respectively staggered to each other so that always a first jet half is adjacent to the second jet half of the adjacent partial jet along the jet slit opening. In the edge region of the so formed jet row sealing plates 7 are placed for sealing both of the external partial jets against the ambient pressure.

The existence of the solid region of the respective second jet halfs 4 secures that more sealing means between the partial jets placed in the center region are not necessary. The solid regions of the second jet halfs rather seal their adjacent first jet halfs with the channel for the pressure medium so that each of the partial jets 2 can be impinged on a pressure medium separately at the compressed-air supply without changing thereby the pressure ratio in the respective adjacent partial jets.

Figure 3:
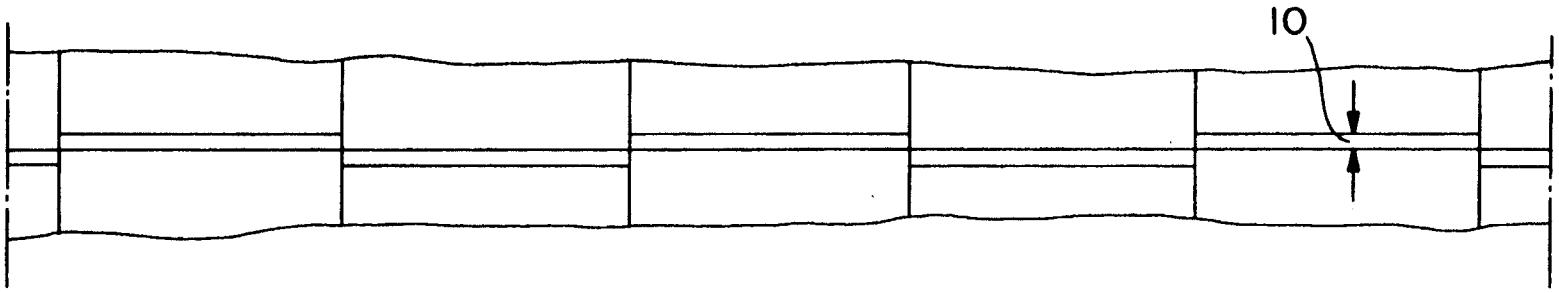
FIG. 3 is a section along line A—A in FIG. 2

Having the row arrangement of the individual partial jets the slit 10 formed in the way of a rectangular function and represented in FIG. 3 is formed, the individual rectangular segments being staggered with the width of the jet slit 10.

Figure 4:
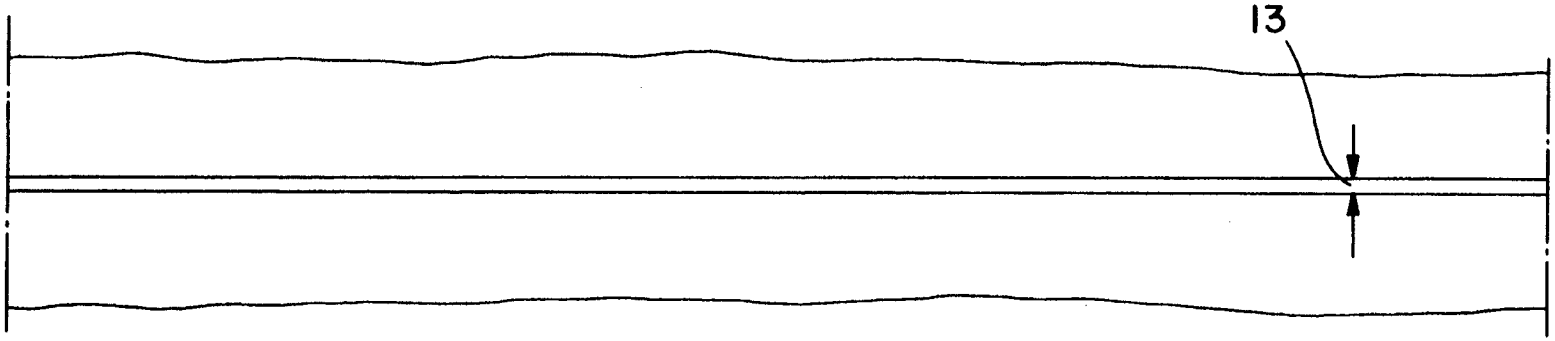
FIG. 4 is a section along line B—B in FIG. 2.

On the contrary the compressed-air slit 13 formed at the point of the other pair of let lips 11, as illustrated in FIG. 4 is linear.

The blowing off device being formed as a jet row with continuous jet slit, the jet slit and the pressure of the blowing off medium are separately adjustable in each blowing off segment. So it is possible for example to work over the whole blowing off region with similar or different blowing off pressure corresponding to the characteristics of the coating agent.

An alternative for smaller adjacent bands is to work a few bands simultaneously by means of one single blowing off device, the blowing off pressures being adequately adapted and differently adjusted. So different coating layers can be produced simultaneously.

We claim:

1. A device for blowing off excess coating material from a metal band by means of a blowing off jet of a blowing off medium, comprising a nozzle structure having a first extended jet slit formed therein extending in a direction which is transverse to said metal band, said blowing off jet emerging from said jet slit to impinge on said metal band, said nozzle structure comprising a plurality of individual nozzle bodies arranged sealingly against each other in a row extending in said transverse direction, each of said nozzle bodies having individually adjustable nozzle lips forming partial jet slits which together form said first extended jet slit, whereby said blowing off jet can be separately controlled with each of said partial jet slits by adjusting said nozzle lips of each of said individual nozzle bodies.

2. The device of claim 1 wherein each of said nozzle bodies comprises a base, a first nozzle body half, and a second nozzle body half, said first nozzle body half having a channel formed therein leading to the partial jet slit associated with it while said second body half seals said channel in a region leading to said partial jet slit.

3. The device of claim 2 wherein said individual nozzle bodies are arranged in said row in an alternating manner, so that the first nozzle body half of a first individual nozzle body is arranged adjacent to and sealingly against the second nozzle body half of an adjacent second nozzle body, and the second nozzle body half of said first nozzle body is arranged adjacent to and sealingly against the first nozzle body half of said adjacent nozzle body.

4. The device of claim 3 further comprising sealing plates arranged in edge regions of said row.

5. The device of claim 4 further comprising a secondary pair of adjustable nozzle lips forming a second extended jet slit running parallel to said first extended jet slit.

6. The device of claim 5 further comprising a seal associated with said secondary pair of adjustable nozzle lips which seals said secondary pair of adjustable nozzle lips against said row of individual nozzle bodies.

* * * * *